United States Patent [19]

Gonzalez et al.

[11] Patent Number: 4,778,008

[45] Date of Patent: Oct. 18, 1988

[54] SELECTIVELY RELEASABLE AND REENGAGABLE EXPANSION JOINT FOR SUBTERRANEAN WELL TUBING STRINGS

[75] Inventors: Manuel E. Gonzalez; William D. Moody, both of Corpus Christi; Richard P. Rubbo, The Woodlands, all of Tex.

[73] Assignees: Exxon Production Research Company; Baker Oil Tools, Inc., both of Houston, Tex.

[21] Appl. No.: 22,098

[22] Filed: Mar. 5, 1987

[51] Int. Cl.[4] ..... E21B 17/06; E21B 17/07; F16L 27/12

[52] U.S. Cl. ..... 166/387; 166/242; 166/64; 285/2; 285/3; 285/18; 285/187; 285/302

[58] Field of Search ..... 166/387, 64, 115, 116, 166/242, 118; 285/302, 2, 3, 4, 18, 319, 187, 307; 175/321

[56] References Cited

U.S. PATENT DOCUMENTS

| | | | |
|---|---|---|---|
| 4,008,759 | 2/1977 | Blackwell | 166/242 |
| 4,040,649 | 8/1977 | Blackwell | 285/18 |
| 4,281,858 | 8/1981 | Bowyer | 285/302 |
| 4,423,889 | 1/1984 | Weise | 285/302 |
| 4,613,159 | 9/1986 | Harris et al. | 285/187 |

*Primary Examiner*—Jerome W. Massie
*Assistant Examiner*—Bruce M. Kisliuk
*Attorney, Agent, or Firm*—Hubbard, Thurman, Turner & Tucker

[57] ABSTRACT

The invention provides an apparatus for limiting tension produced in a tubular string extending from a packer set in a subterranean well to the well surface. Such apparatus comprises a receptacle secured to the packer and defining an elongated seal bore, and a mandrel telescopically and sealably related to the seal bore, the mandrel being connected to the bottom end of the tubing string. In one embodiment, a collet, incorporated in the receptacle for cooperating with an abutment formed on the mandrel, thereby securing the mandrel and the receptacle in a telescopically contracted position until sufficient tensile force is exerted on the mandrel to cause the collet arms to be expanded by the abutment to permit upward movement of the mandrel relative to the receptacle.

17 Claims, 3 Drawing Sheets

SELECTIVELY RELEASABLE AND REENGAGABLE EXPANSION JOINT FOR SUBTERRANEAN WELL TUBING STRINGS

BACKGROUND OF THE INVENTION

1. FIELD OF THE INVENTION

This invention relates to a selectively releasable and re-engagable expansion joint for use in connecting a tubing string to a packer set at a preselected location in a subterranean well.

2. SUMMARY OF THE PRIOR ART

In the treatment and production of subterranean oil and gas wells, it has been common to run a tubing string from the well surface to a packer set at a preselected location above a production zone. In the case of wells of substantial depth, and particularly wells where the downhole temperatures are substantially in excess of the surface temperatures, problems have been encountered due to excessive expansion or contraction of the elongated tubing string For example, in the treatment or stimulation of the well, it is common to introduce fluids at surface ambient temperature into the tubing string. When the major portions of the tubing string are at a much higher temperature, this inherently results in a cooling, and hence a substantial contraction of the tubing string, resulting in the production of a substantial tensile stress in the tubing string between its surface connection and the set packer. Similarly, in the production phase of such wells, the production fluid is normally at a temperature substantially in excess of the temperature of the majority of the tubing string, resulting in a substantial expansion of the tubing string and the production of a substantial compressive force on the tubing string.

Additionally, changes in fluid pressure inside and outside the tubing string play a major role in the development of substantial tension or compressive forces in the tubing string.

The prior art has attempted to cope with this problem by incorporating expansion joints in the tubing string and generally located between the bottom of the tubing string and the packer. Such expansion joint may, for example, comprise an elongated seal bore receptacle attached to the packer within which there is sealingly telescopically mounted a mandrel connected at its upper end to the tubing string and relatively movable with respect to the seal bore of the receptacle in response to the changes in tension or compression in the tubing string. Such relatively movable telescoped elements require a plurality of dynamic seals disposed therebetween to maintain the sealing integrity of the tubing string. As a result, such seals are continuously subject to axial motions and, as is wellknown in the art, movable seals tend to deteriorate more rapidly than the non-movable seals under the adverse environmental conditions encountered in subterranean wells. To overcome this problem, the prior art practice has been to land the tubing string with a sufficient amount of compression to prevent dynamic movement of the expansion joint during all cycles except treatment or stimulation; however, this technique results in the development of excessive compressive forces during production modes, thus threatening the structural integrity of the tubing string.

It would therefore be desirable to provide an expansion joint which did not permit movement of the seal elements until the tension in the tubing string approaches the level where fracture of the tubing string might be encountered, as during treatment or stimulation of the well. Following the treatment or stimulation, the flowing of the well would result in an expansion of the compressed tubing string and the mandrel of the expansion joint would move back to its original contracted position relative to the seal bore receptacle where it would be again latched so as to prevent relative movement of the seals along the seal bore until an extreme tensile stress condition was again encountered.

SUMMARY OF THE INVENTION

This invention provides an apparatus for limiting tension produced in a tubular string extending from a packer set in a subterranean well to the well surface. An axially expandable connection tool is provided which is disposed intermediate the packer and the tubing string. Preferably, such connection tool may comprise an elongated seal bore receptacle rigidly mounted at its bottom end to the set packer. The other component of the expandable connection tool comprises a mandrel element which is connected at its top end to the tubing string and which is telescopically related to the seal bore of the seal bore receptacle. Conventional dynamic seals are provided between the exterior of the mandrel and the seal bore of the receptacle to preserve the fluid pressure integrity of the tubing string.

The mandrel is detachably secured in a substantially fully inserted position relative to the seal bore receptacle by, for example, a collet formed as an integral part of the seal bore receptacle and cooperating with an abutment on the mandrel to secure the mandrel in said telescopically contracted position relative to the seal bore. Thus, when treatment or stimulation of the well occurs, the resulting decrease in temperature of the tubing string produces a substantial degree of tension in the tubing string which is resisted by the latching engagement between the collet on the seal bore receptacle and the abutment on the mandrel. When such tensile forces approach a level to threaten the mechanical integrity of the tubular string, the collet releases and permits the mandrel to move upwardly relative to the seal bore receptacle, thus substantially reducing the tension in the tubing string.

When the treatment or stimulation is completed, and the well is placed back into production, the relatively hot formation fluids traveling up the tubing string will produce an expansion of the tubing string which will be readily absorbed by the mandrel moving downwardly with respect to the seal bore receptacle. Such downward movement is generally sufficient to effect the re-engagement of the abutment on the mandrel with the collet formed in the seal bore receptacle so that the expandable connection joint is automatically restored to its original nonexpandable condition and will remain in that condition until the tubing string is again subjected to tension forces approaching that which threaten the mechanical integrity of the tubing string.

In this manner, the amount of movement of the dynamic seals operating between the mandrel and the seal bore of the seal bore receptacle is significantly reduced and, as a result, the life of such seals is substantially extended. Stated differently, the advantage of the apparatus embodying this invention is its ability to prevent dynamic seal movement during all but treatment modes without incurring large compressive tubing to packer loads during production.

In an alternative embodiment of the invention, the mandrel is detachably secured in a substantially fully inserted position relative to the seal bore receptacle by a collet mounted on the upper portions of the mandrel which successively cooperates with a plurality of axially stacked abutment rings shearably mounted within the bore of the hollow receptacle above the seal bore.

The collet is mounted on the hollow mandrel for limited axial movement and the mandrel is provided with an annular external shoulder which, upon contraction of the tubing string, will move into engagement with the locking heads of the collet to hold them in their locked position relative to the particular abutment ring with which they are engaged whenever tension exists in the tubing string. Thus, the expansion joint cannot expand until the tension in the tubing string reaches a predetermined level at which the shearable connection of the abutment ring will shear. Upon occurrence of the shearable release of the abutment ring, the mandrel is free to move upwardly relative to the hollow receptacle to relieve the tension in the tubing string.

In the preferred embodiment of the invention, each abutment ring is formed as an expandable C-ring which is held in a compressed condition in its initial assembly in the hollow receptacle. The hollow receptacle is provided with an annular storage space above the initial position of the abutment rings, and each abutment ring is successively moved to such storage space by the upward movement of the mandrel resulting from the shearable release of the particular abutment ring from the receptacle. Upon reaching the storage space, the C-ring design of the abutment ring causes it to expand into the storage space and thus be disposed out of the path of the collet for all subsequent reciprocations of the collet.

Upon subsequent expansion of the tubing string, the collet moves downwardly into engagement with the next lower abutment ring and thus the mandrel is again locked against expansion movement with respect to the hollow reeptacle until the same predetermined degree of tension occurs in the tubing string.

Stated differently, the advantage of each apparatus embodying this invention is its ability to prevent dynamic seal movement during all but treatment modes without incurring large compressive tubing to packer loads during production.

Further advantages of the invention will be readily apparent to those skilled in the art from the following detailed description, taken in conjunction with the annexed sheets of drawings, upon which is shown a preferred embodiment of the invention.

DESCRIPTION 0F PREFERRED EMBODIMENTS

Figure 1:
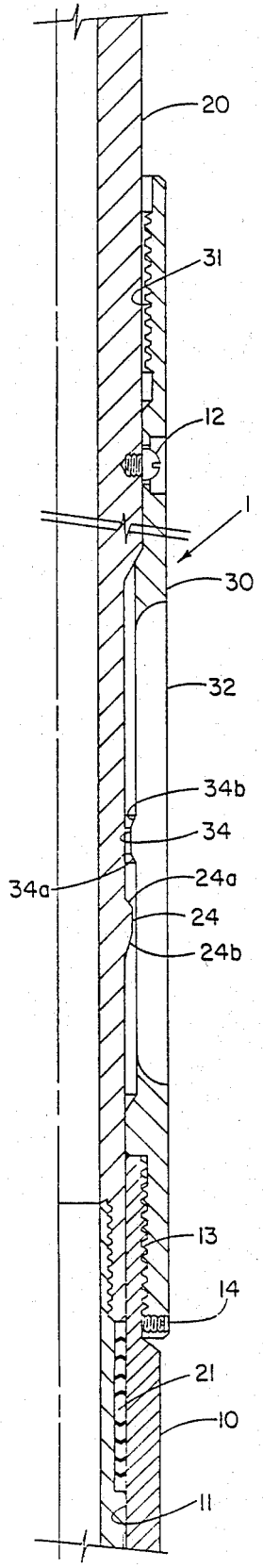
FIG. 1 is a vertical, quarter-sectional view of an expansion tool embodying this invention, with the components of the tool shown in a fully contracted position.

Referring to the drawings, a selectively releasable tension joint 1 embodying this invention comprises an axially elongated seal bore receptacle 10 which is rigidly secured at its bottom end to a packer (not shown) which is set at a desired location in a well with respect to a production formation. The receptacle 10 is of substantial axial length so as to freely accommodate the maximum amount of expansion of the tubing string that would occur in the treatment or operation of the well. A hollow mandrel 20 is provided which is conventionally connected at its upper end to a tubing string (not shown) and has its lower end telescopically related to the axially extending seal bore 11 defined by the receptacle 10. A plurality of axially spaced sets of axially stacked seals 21 are conventionally mounted on the exterior of the mandrel 20 to cooperate in sealing relationship with the seal bore surface 11.

In the run-in position of the apparatus shown in FIG. 1, the mandrel 20 is maintained in a contracted position by a collet 30, and by one or more shear screws 12 which pass through the wall of the sleeve portion of a collet 30 which is rigidly secured at its lower end to external threads 13 provided on the top end of the receptacle 10. Threads 13 are secured by a set screw 14. Internal threads 31 are provided in the top end of the collet sleeve for engagement by a retrieval tool.

Figure 2:
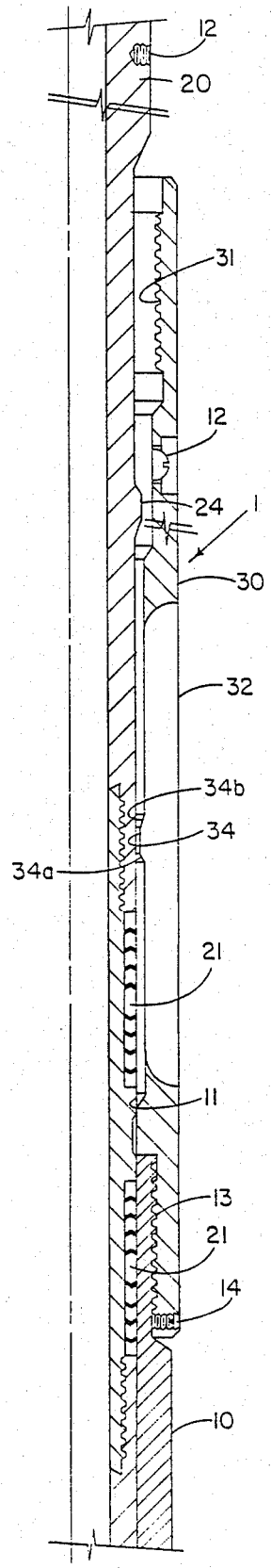
FIG. 2 is a view similar to FIG. 1, but showing the components of the tool in an expanded position which it assumes after the occurrence of a substantial degree of tension in the tubing string.

The medial portion of collet sleeve 30 is machined to define a plurality of peripherally spaced collet arms 32, each of which defines an internally projecting locking head 34. Mandrel 20 is provided with an external locking shoulder or abutment 24 which has an upwardly facing inclined camming surface **24*a* engagable with the downwardly facing, inclined surface 34*a* of the collet locking heads 34. Such engagement prevents any substantial expansion movement of the mandrel 20 relative to the seal bore receptacle 10 until sufficient tensile force is exerted on the mandrel 20 by the tubing string to force an outward deflection of the collet arms 32 and permit the abutment 24 on the mandrel to pass the locking heads 34, as illustrated in FIG. 2. Of course, the application of a small tensile force to the mandrel 20, much less than that required to produce a passage of the abutment 24 past the locking heads 34, will effect the shearing of the shear screws 12**.

Those skilled in the art will appreciate that it is possible by designing a desired degree of stiffness into the collet arms 32 to prevent the passage of the abutment 24 until the tension in the tubing string approaches a level that would be threatening to the mechanical integrity of the tubing string. At this point, the abutment 24 forces the locking heads **34*a*** radially outwardly and moves upwardly to release the tension in the tubing string. After the packer is set, a substantial compressive force is set down on the tubing string to absorb minor tensile forces, but low enough to insure that expansion of the tubing string, when in the production mode, will not exceed the strength of the tubing string.

When the tension in the tubing string is removed and replaced by a compressive force, such as would occur upon the initiation or resumption of production flow from the well, the accompanying thermal expansion of the tubing string will move the mandrel 20 downwardly and produce an outward deflection of the collet locking heads 34 by the abutment 24 to restore the expansible joint to its original condition. The downwardly facing surface 24*b* on the locking abutment 24 has a much more gradual inclination, as does the upwardly facing surface 34*b* of the locking heads 34, so that such outward displacement of the collet arms 32 occurs without requiring a substantial compressive force to be exerted on the tubing string. Thus, upward movement of the mandrel 20 and the seals 21 with respect to the seal bore 11 of the seal bore receptacle 10 is effectively prevented until a sufficiently large tensile force is produced in the tubing string as to threaten its mechanical integrity. As a result, the seals 21 are subject to much less movement relative to the seal bore 11, and the life of such seals is substantially prolonged.

Referring now to FIGS. 3A, 3B, 4A, and 4B of the drawings, an alternative selectively releasable tension joint 1' embodying this invention comprises an axially elongated seal bore receptacle 100 which is rigidly secured at its bottom end to a packer (not shown) which is set at a desired location in a well with respect to a production formation. The receptacle 100 is of substantial axial length so as to freely accommodate the maximum amount of expansion of the tubing string that would occur in treatment or operation of the well.

A hollow mandrel 200 is provided which is conventionally connected at its upper end by internal threads 200*a* to a tubing string (not shown) and has its lower end telescopically related to the axially extending seal bore 110 defined in the lower portions of the receptacle 100. A plurality of axially spaced sets of axially stacked seals 210 are conventionally mounted on the exterior of the mandrel 200 to cooperate in sealing relationship with the seal bore surface 110.

The seal bore receptacle 100 comprises a lower elongated sleeve 120 defining the seal bore 110. Sleeve 120 is provided at its upper end with external threads 120*a* which cooperate with internal threads provided on the lower end of an upper receptacle portion 140. This connection is secured by a set screw 120*b*. Upper receptacle portion 140 is provided with a plurality of axially spaced annular grooves 140*a*. These grooves respectively receive the shearable portion 160*a* of an anchor C-ring 160. Each C-ring 160 is in turn engaged in an annular space defined between an abutment ring 180 and the internal bore surface 140*b* of the upper receptacle portion 140. Each abutment ring 180 is formed as an expandable C-ring which is maintained in its compressed position by the bore surface 140*b* of the receptacle. Each abutment ring 180 defines an annular locking recess 180*b* on its inner surface for a purpose to be hereinafter described. The lowermost ring 180 abuts an upwardly facing shoulder 120*e* on sleeve 120 and spacers 190 are provided between the abutment rings 180.

Above the grooves 140*a*, the upper receptacle portion 140 is provided with a radially enlarged, annular recess 140*c* which functions as a storage space for the abutment rings 180 as will be hereinafter described. Lastly, the top portion of the upper receptacle portion 140 is provided with conventional internal threads 140*d* for engagement by a conventional retrieval tool.

Figure 4A:
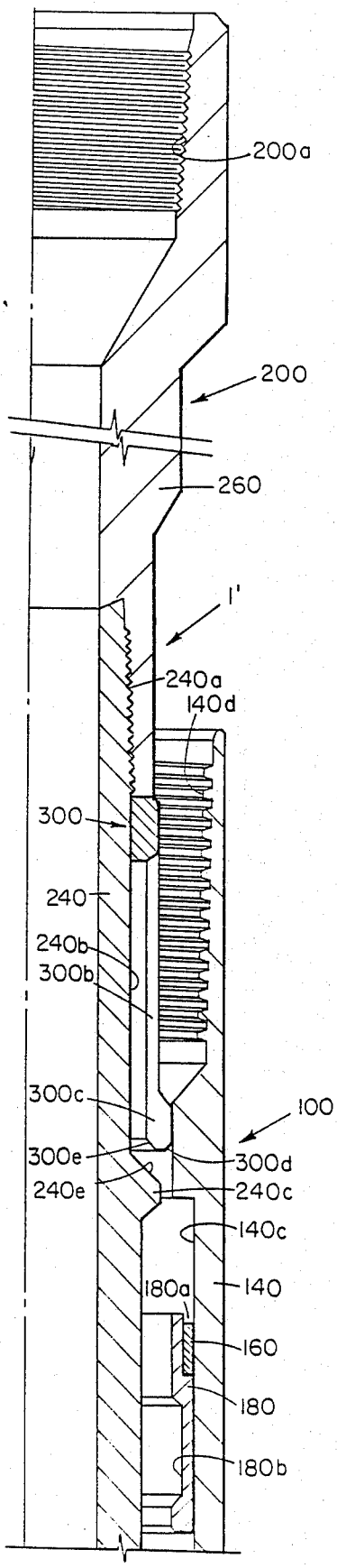
FIGS. 4A and 4B respectively correspond to FIGS. 3A and 3B, but showing the position of the elements thereof following the release of the expansion joint in response to a predetermined amount of tensile stress in the tubing string.
Figure 4B:
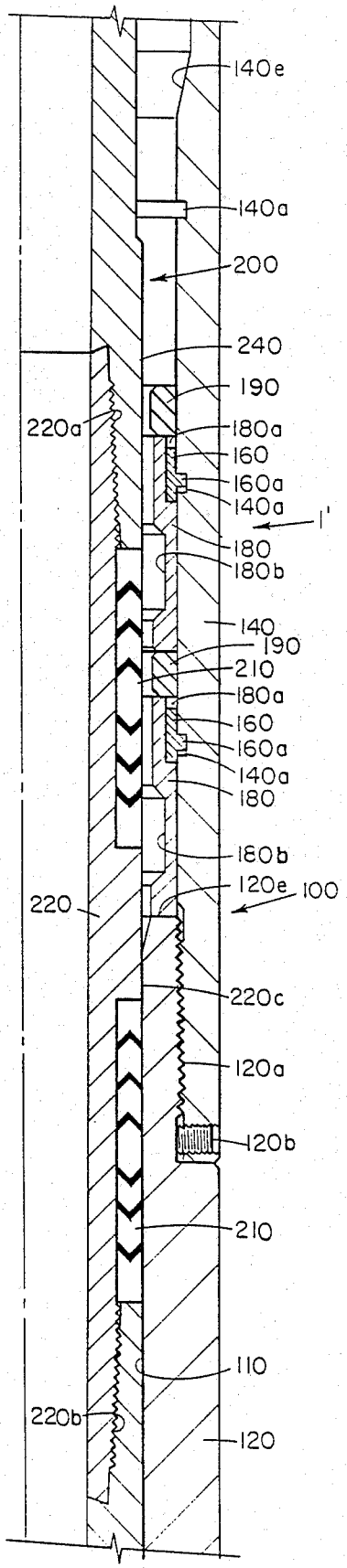

The hollow mandrel 200 comprises an assemblage of tubular elements. As will be understood by those skilled in the art, a plurality of axially spaced sets of axially stacked seal units 210, of which only two are shown on the drawings, are mounted on the mandrel 200. Generally, such mounting comprises a seal mounting sleeve 220 having a radially enlarged shoulder 220*c* formed on its medial portions. Both end portions of seal mounting sleeve 220 are provided with external threads 220*a* and 220*b* respectively for engagement with other portions of the mandrel assembly. Each seal stack 210 is then located between the shoulder 220*c* and the adjacent end face of the next tubular portion of the mandrel assemblage. For example, as shown in FIG. 4B, the next adjacent portion comprises a collet mounting sleeve portion 240. Sleeve portion 240 is in turn provided at its upper end with external threads 240*a* for engagement with a conventional connecting sub 260 which connects to the bottom end of a tubing string (not shown) in conventional fashion by threads 200*a*.

Collet mounting sleeve portion 240 is provided adjacent its upper end with an external cylindrical surface 240*b* on which the ring portion 300*a* of a collet 300 is slidably mounted. The axial movement of collet 300 is limited by engagement with the bottom end of the sub 260 in an upward direction, and in a downward direction, with an outwardly projecting shoulder 240*c* provided on the collet mounting sleeve 240. Collet 300 has a plurality of peripherally spaced locking arms 300*b* integrally connected with the ring portion 300*a* and terminating in outwardly projecting locking head portions 300*c*. The collet locking heads 300*c* are proportioned to readily snap into the collet receiving recesses 180*b* formed on the inner surfaces of the abutment rings 180. In the initial or run-in position of the expansion joint, the collet locking heads 300*c* are positioned in the recess 180*b* of the uppermost abutment ring 180, but after the uppermost ring is successfully stored in annular recess 140*c*, through the provision of inclined surfaces 300*d* on the bottom end of the locking heads 300*c*, the collet locking heads 300*c* can be forced downwardly into successive engagement with each of the recesses 180*b* of the lower abutment rings 180.

Figure 3A:
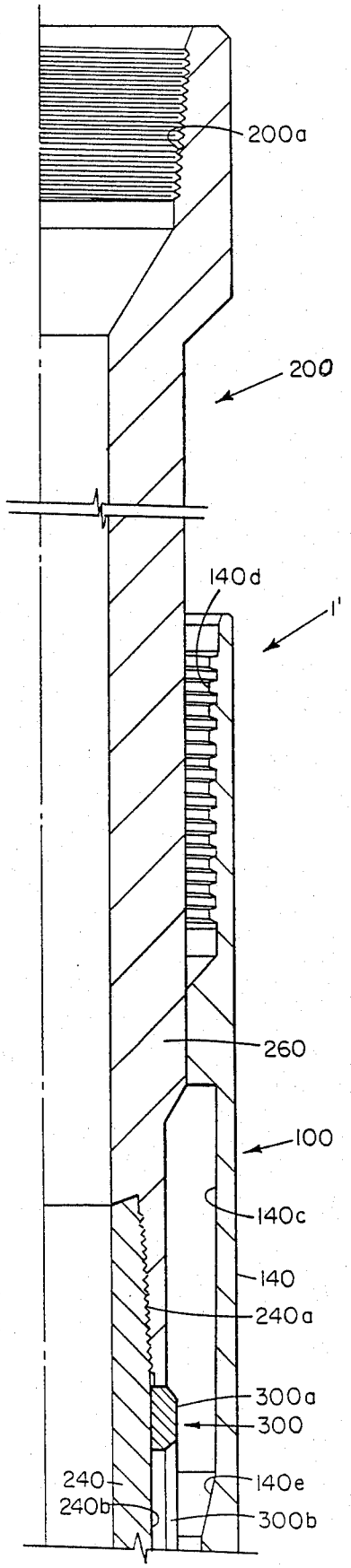
FIGS. 3A and 3B collectively represent a vertical quarter-sectional view of an alternative apparatus embodying this invention, showing the elements thereof in the run-in position.
Figure 3B:
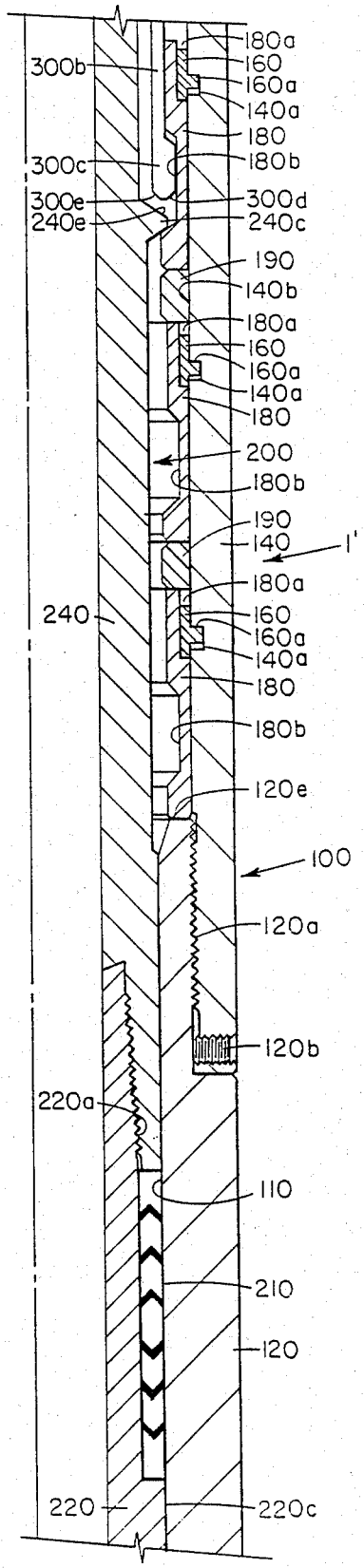

When the expansion joint embodying this invention is run into the well in its run-in position illustrated in FIGS. 3A and 3B, the locking heads 300*c* are resiliently biased into engagement with the collet receiving recess 180*b* of the uppermost abutment ring 180. After the packer is set, a substantial compressive load is set down on the tubing string to absorb minor tensile forces, but low enough to insure that the tubing string expansion, when in the production mode, will not exceed the strength of the tubing string. Upon the occurrence of any large tensile forces in the tubing string, however, the mandrel 200 is pulled upwardly and this movement brings the inclined surface 240*e* of an annular radial projection 240*c* into abutting engagement with the bottom end surface 300*e* of the locking heads 300*c* of the collet 300. Thus, the collet locking heads are trapped within the annular recess 180*b* of the uppermost abutment ring 180 and further expansion movement of the mandrel 200 relative to the receptacle 100 is prevented.

When the tensile force in the tubing string reaches a predetermined level, less than the mechanical strength of the tubing string, the shear ring portion 160*a* of the anchor ring 160 of the uppermost abutment ring 180 is sheared by the occurrence of such predetermined tensile force and the mandrel is free to move upwardly. Such upward movement is also imparted to the uppermost abutment ring 180 until it clears the beveled shoulder 140*e* communicating with the enlarged annular recess 140*d*. Upon reaching this location, the C-ring construction of the anchor ring 160 and abutment ring 180 causes such rings to expand into the storage space provided by the annular recess 140*c*. The uppermost abutment ring 180 is thus placed in a position where it will no longer be engaged by the locking heads 300*c* of the collet 300 or the shoulder 240*c*.

Subsequent expansion of the tubing string, such as produced by putting the well back into production, will effect a downward or contracting movement of the mandrel 200 relative to the receptacle 100. Such movement continues until the locking heads 300*c* of the collet 300 engage the collet receiving recess 180*b* of the next lower abutment ring 180, whereupon such abutment ring will be engaged and will function to prevent subsequent upward movement of the collet 180 when a tensile force is again applied to the tubing string, as by a treatment operation. When the tensile force in the tubing string reaches the predetermined level, the shear ring portion 160*a* of the ring 160 will shear and will permit the mandrel 200 to move upwardly relative to the receptacle 100, carrying with it the second abutment ring 180 for storage in the annular storage space 140*c*.

While only three annular abutment rings 180 are shown in the drawings, those skilled in the art will understand that any number of such abutment rings may be employed. It is only necessary to elongate the annular storage space 140*c* to a degree sufficient to accommodate the additional abutment rings 180. Thus, the expansion joint embodying this invention may be selectively released upon the occurrence of a predetermined tension in the tubing string and then reengaged to resist subsequent tensile force in the tubing string until another predetermined level of such tensile force is reached. This operation may be repeated as many times as there are abutment rings 180 mounted in the receptacle 100.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be seucred by Letters patent are:

1. Apparatus for preventing temperature-induced tension failure of a tubing string of a producing subterranean well extending from a packer set in the well above a formation producing heated fluids to a fixed mounting at the well head, comprising: an expansion tool connectable in series relation with the tubing string; said expansion tool comprising two components slidably and sealably connected in telescopic relation; collet means on one said component having radially biased locking heads; abutment means on said other component cooperable with said collet locking heads to secure said components in a telescopically contracted position; means responsive to a predetermined tension in the tubing string for releasing the securement of said components to permit expansion thereof to reduce tension in the tubing string; said predetermined tension approaching but being less than the tensile strength of said tubing string; said collet locking heads being reengagable with said abutment means upon subsequent contraction of the tubing string.

2. The apparatus of claim 1 wherein said collet means comprises a plurality of peripherally spaced collet arms integrally formed in the wall of said other component.

3. The apparatus of claim 1 wherein said abutment means comprises an annular external shoulder on the innermost one of said components, and said collet means comprises a plurality of peripherally spaced collet arms on said outermost component having inwardly projecting head portions cooperating with said annular external shoulder.

4. The apparatus of claim 3 wherein said outermost component is tubular and and said collet arms are integrally formed in the tubular wall of said outermost component.

5. The apparatus of claim 1 wherein said abutment means comprises a vertical stack of expandable C-rings compressed within said other component; means for separately shearably securing each said C-ring to said other component; said other component defining a storage space above said stack for said C-rings to expand into; said collet locking heads being initially engaged with the uppermost one of said C-rings to shearably release said uppermost C-ring and move said uppermost said C-ring upwardly into said storage space upon occurrence of said predetermined tension in the tubing string, and lockingly engage the next uppermost C-ring upon subsequent contraction of the tubing string.

6. The apparatus of claim 1 wherein said abutment means have a downwardly facing, inclined camming surface; said locking heads having upwardly facing, inclined locking surfaces cooperating with said camming surface; the angle of inclination of said cooperating surfaces being selected to prevent release of said locking heads from said abutment means by said predetermined tensile force in said tubing string.

7. The method of preventing temperature-induced tension failure of a tubing string of a producing subterranean well due to introduction of well treatment fluids through the tubing string wherein the tubing string extends from a packer set in the well above a formation producing heated production fluids to a fixed mounting at the earth surface, comprising the steps of inserting an expansion joint in series relation to the tubing string, the expansion joint comprising two components slidably and sealably connected in telescopic relation; securing said two components together in a telescopically contracted position by a collet secured to one component and an abutment secured to the other component, releasing said securement in response to a predetermined tension force in the tubing string produced by the introduction of well treatment fluids; and resecuring said components by said collet when the tensile force on the tubing string is released and the tubing string is contracted by resumption of production of heated fluids.

8. The method of claim 7 wherein said abutment comprises a vertical stack of expandable C-rings and further comprising the step of mounting the stack of C-rings in said other component and separately shearably securing each C-ring to said other component; initially engaging the top C-ring of the stack by said collet, removing the top C-ring by said collet by expansion movement of the tubing string to a storage space in said other component, and re-securing said collet to the next lower C-ring in the stack upon subsequent contraction of the tubing string.

9. Apparatus for limiting tension produced in a tubular string extending from a packer set in a subterranean well to the earth surface, comprising, in combination: an axially expandable connection tool adapted to be disposed intermediate the packer and the tubing string, said connection tool having inner and outer telescopically related components, one component being securable to the packer and the other component being securable to the tubing string; sealing means for preventing fluid flow between said telescopically related components; a plurality of abutment rings shearably secured in axially spaced relation to one of said components; resilient, radially deflectable means secured to said other component for successively engaging said abutment rings as said components are relatively moved to their fully contracted positions; said resilient radially deflectable means being initially positioned in engagement with the uppermost one of said abutment rings to secure said components in a telescopically contracted position; means responsive to tension in the tubing string for locking said resilient radially deflectable means in an engaged position with the adjacent abutment ring; whereby a predetermined degree of tension in the tubing string shearably releases said uppermost abutment ring from said one component, thereby expanding said connection tool to reduce the tension in the tubing string; subsequent expansion of the tubing string producing engagement of said resilient radially deflectable means with the next lower abutment ring.

10. The apparatus of claim 9 wherein said one component defines an annular storage space above said abutment rings; said abutment rings being successively transferred to said storage space by successive occurrences of said predetermined tension in the tubing string.

11. The apparatus of claim 10 wherein said abutment rings comprise expandable C-rings, whereby each C-ring successively expands into said annular storage space by upward movement of the C-ring following its shearable release from said one component.

12. The apparatus of claim 10 wherein said abutment rings comprise expandable C-rings, whereby each C-ring successively expands into said annular storage space by upward movement of the C-ring following its shearable release from said one component.

13. The apparatus of claim 9 wherein said resilient, radially deflectable means comprises a collet having locking heads engagable in succession with said abutment rings.

14. The apparatus of claim 13 wherein said one component defines an annular storage space above said abutment rings; said abutment rings being successively transferred to said storage space by successive occurrences of said predetermined tension in the tubing string.

15. Apparatus for limiting tension produced in a tubular string extending from a packer set in a subterranean well to the earth surface, comprising, in combination: an axially expandable connection tool adapted to be disposed intermediate the packer and the tubing string, said connection tool having inner and outer telescopically related components, said outer component comprising a hollow receptacle having a lower end securable to the packer and defining an elongated seal bore; said inner component comprising a hollow mandrel and having an upper end securable to the tubing string; sealing means preventing fluid flow between said mandrel and said seal bore; a plurality of axially spaced abutment rings mounted in vertically stacked relation within the bore of said hollow receptacle above said seal bore; means for shearably connecting each ring to said holow receptacle; a collet mounted on said mandrel for limited axial movement and having peripherally spaced locking heads resiliently engagable in succession with said abutment rings as said mandrel is moved toward its fully contracted position relative to said receptacle; said locking heads being initially engaged with the uppermost abutment ring to resist upward movement of said mandrel relative to said receptacle; an external shoulder on said mandrel below said locking heads, whereby tension in the tubing string moves said shoulder in engagement with said locking heads to prevent radially inward movement thereof and whereby a predetermined tension in the tubing string produces a shearing of said shearable connecting means of the uppermost abutment ring to permit said mandrel to move upwardly relative to said receptacle and reduce the tension in the tubing string; subsequent expansion of the tubing string producing an engagement of said collet locking heads with the next lower abutment ring to prevent upward movement of said mandrel until said predetermined tension reoccurs in the tubing string.

16. The apparatus of claim 15 wherein said receptacle defines an annular storage space above the initial position of said abutment rings, said abutment rings being successively transferred to said annular storage space by successive occurrences of said predetermined tension in the tubing string.

17. The apparatus of claim 16 wherein said abutment rings comprise expandable C-rings, whereby each C-ring successively expands into said annular storage space by upward movement of the C-ring following its shearable release from said receptacle.

* * * * *